US006854443B2

(12) United States Patent
Keefover et al.

(10) Patent No.: US 6,854,443 B2
(45) Date of Patent: Feb. 15, 2005

(54) ASSEMBLY FOR ELECTRONIC THROTTLE CONTROL WITH NON-CONTACTING POSITION SENSOR

(75) Inventors: Robert Keefover, Farmington Hills, MI (US); Michael Halsig, Warren, MI (US); Hal Pringle, Bloomfield, MI (US)

(73) Assignee: BorgWarner Inc., Auburn Hills, MI (US)

( * ) Notice: Subject to any disclaimer, the term of this patent is extended or adjusted under 35 U.S.C. 154(b) by 8 days.

(21) Appl. No.: 10/383,194

(22) Filed: Mar. 6, 2003

(65) Prior Publication Data

US 2003/0178004 A1 Sep. 25, 2003

Related U.S. Application Data

(60) Provisional application No. 60/362,032, filed on Mar. 6, 2002.

(51) Int. Cl.[7] ..... F02D 9/08

(52) U.S. Cl. ..... 123/337; 123/399

(58) Field of Search ..... 123/399, 337, 123/361; 251/189.11, 305

(56) References Cited

U.S. PATENT DOCUMENTS 4,392,375 A * 7/1983 Eguchi et al. ..... 73/118.1
5,055,781 A * 10/1991 Sakakibara et al. .... 324/207.21
5,528,139 A 6/1996 Oudet et al.
5,532,585 A 7/1996 Oudet et al.
5,544,000 A * 8/1996 Suzuki et al. ..... 361/139
5,681,990 A * 10/1997 Hampo et al. ..... 73/118.2
5,789,917 A 8/1998 Oudet et al.
6,288,534 B1 * 9/2001 Starkweather et al. ... 324/207.2
6,289,874 B1 9/2001 Keefover
6,407,543 B1 * 6/2002 Hagio et al. ..... 324/207.25
6,483,296 B1 * 11/2002 Hamaoka et al. ..... 324/207.25
6,491,019 B1 * 12/2002 Apel ..... 123/337
6,499,461 B2 * 12/2002 Kubota et al. ..... 123/361
6,543,417 B2 * 4/2003 Tanaka et al. ..... 123/399
6,591,809 B2 * 7/2003 Saito et al. ..... 123/399
6,701,892 B2 * 3/2004 Hashimoto et al. ..... 123/399
6,725,833 B1 * 4/2004 Irihune et al. ..... 123/399

* cited by examiner

*Primary Examiner*—Hai Huynh
(74) *Attorney, Agent, or Firm*—Warn, Hoffmann, Miller & LaLone, P.C.; Greg Dziegielewski

(57) ABSTRACT

An electronic throttle control system is described. The system includes a non-contacting sensor stator integrated into an electronic throttle body and is aligned to the sensor rotor attached to the shaft to properly set sensor air gap by assembly aids or by close fit to the throttle body. A motor and vehicle connector is electrically connected to the sensor stator but is allowed to be positioned separately from the sensor stator by means of a flexible interconnect.

20 Claims, 7 Drawing Sheets

ASSEMBLY FOR ELECTRONIC THROTTLE CONTROL WITH NON-CONTACTING POSITION SENSOR

This application claims the benefit of U.S. Provisional application No. 60/362,032 filed on Mar. 6, 2002.

FIELD OF THE INVENTION

The present invention generally relates to electronic throttle control systems and more particularly to electronic throttle control systems having non-contacting position sensors.

BACKGROUND OF THE INVENTION

Traditional engine fuel control systems use a mechanical linkage to connect the accelerator pedal to the throttle valve. Engine idle speed is then controlled by a mechanical system that manipulates the pedal position according to engine load.

Since the mid-1970's electronic throttle control or "drive-by-wire" systems have been developed. Electronic throttle control systems replace the mechanical linkage between the accelerator pedal and the throttle valve with an electronic linkage. These types of systems have become increasingly common on modern automobiles.

Generally, at least one sensor is typically placed at the base of the accelerator pedal and its position is communicated to the engine controller. At the engine, a throttle position sensor and an electronically controlled motor then regulate the throttle to maintain a precise engine speed through a feedback system between the throttle position sensor and the electronically controlled motor. An example of an electronic throttle control system can be found with reference to U.S. Pat. No. 6,289,874 to Keefover, the entire specification of which is incorporated herein by reference.

In conventional electronic throttle control systems, the various components of the throttle position sensor stator and connector assembly are mounted to the casting. The connector assembly is also connected to the motor. Thus, the throttle position sensor stator and the connector assembly move simultaneously during assembly and thermal expansion, thus possibly allowing one or both of them to become misaligned, which could potentially affect performance of the electronic throttle control system.

SUMMARY OF THE INVENTION

In accordance with the general teachings of the present invention, a new and improved electronic throttle control system is provided.

An electronic throttle control system having a housing with a throttle bore. A throttle shaft connected to a throttle plate is disposed within the throttle bore to form the throttle member. A sensor assembly is operably aligned with the throttle shaft for determining the angular position of the throttle plate. A motor is operably associated with the throttle shaft for effecting the movement of the throttle shaft in reponse to a control signal that is inputted from an electrical connector which also distributes connections from the sensor assembly. A flexible interconnect is connected between the sensor assembly and the electrical connector and serves as a medium for the transmission of signals between the sensor stator and the motor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
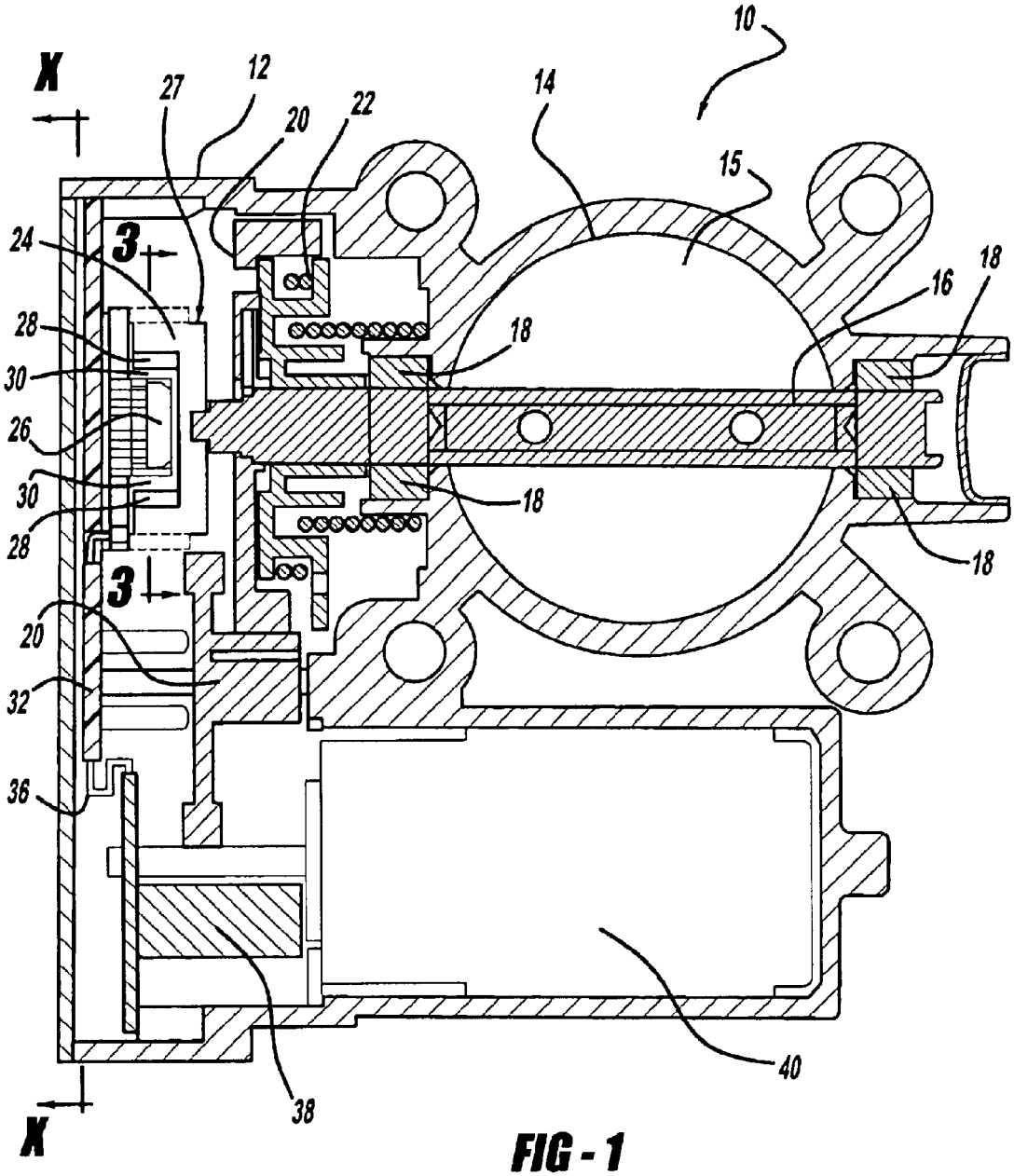
FIG. 1 is a cross-sectional view of an electronic throttle control system, in accordance with the general teachings of the present invention.

Referring to FIG. 1 there is generally shown an electronic throttle control system 10, in accordance with the general teachings of the present invention.

The system 10 generally includes a casting 12 that serves as a housing or support for the various components of the system. Formed within the casting 12 is a throttle bore 14 having a throttle plate 15 rotatably disposed inside the throttle bore 14. A throttle shaft 16 is attached to and extends across the throttle plate 15. The throttle shaft 16 rotates the throttle plate 15 between the open and closed positions. The throttle shaft 16 is supported on both ends by a pair of bearings 18 to aid in the rotation of the throttle plate 15 and throttle shaft 16. At one end of the throttle shaft 16, a gear train 20 envelops the throttle shaft for effecting movement of the throttle shaft 16. Additionally, a spring system 22 is also provided at one end of the throttle shaft 16 as part of a fail-safe system (not shown).

At the extreme end of the throttle shaft 16, a substantially U-shaped sensor rotor 24 is fastened thereto. Although the rotor 24 is shown as being substantially U-shaped, it should be appreciated that the rotor 24 may be configured in any number of shapes, including but not limited to a cylindrical or flat member. The rotor 24 is preferably nested in close proximity to sensor stator 26 and together the two generally form a sensor assembly 27. Thus, it should be appreciated that the rotor 24 is capable of rotating about the stator 26. Although the stator 26 is shown as being substantially U-shaped, it should be appreciated that the stator 26 may be configured in any number of shapes, including but not limited to a flat member.

The axial position of the rotor 24 is preferably maintained by controlling the axial position at which it is attached to the throttle shaft 16; however, this position can be fixed or adjustable.

The stator 26 is fastened to a printed circuit board 32, which is preferably fastened to the housing 12. Axial position control is preferably maintained by attaching the printed circuit board 32 to a controlled fixed surface such as the casting 12. Tight radial position control is preferably maintained between the rotor 24 and the stator 26 through the assembly process or through dimensional control of the printed circuit board 32 and a fixed surface such as the casting 12. This tight radial positioning is preferably maintained by carrying out an alignment method which may incorporate an alignment means. One method of alignment involves the use of pre-molded slots (depicted in FIG. 2) in the casting so each of the individual components can be aligned by sliding into the slots. A second method of alignment (depicted in FIGS. 4, 4*a*, 4*b*) uses an alignment tool to hold the stator and printed circuit board in place. And yet a third method of alignment (depicted in FIG. 5.) use of tapered pins 50 that are inserted between the stator and rotor during attachment of the printed circuit board to the casting. Each of these alignment means will be described in greater detail later in this description.

The printed circuit board 32 and the stator 26 are preferably fastened in place by one or more fasteners (not shown) that are inserted through one or more apertures 34 formed on the surface of the casting 12 adjacent to the printed circuit board 32.

Fastened to the printed circuit board 32 is a preferably flexible interconnect 36 that electrically connects the printed circuit board 32 to a connector 38. The flexible interconnect 36 reduces stress on the printed circuit board 32 and allows the printed circuit board 32 to be positioned separately from the connector 38. The connector is preferably fastened to the casting 12. The connector 38 is in turn electrically connected to a motor 40 which is preferably fastened to the casting 12. Several types of motors may be within the scope of this invention. For instance the motor may be a brush motor, a DC motor, a brushless motor, a solenoid, pneumatic or a stepper motor. Any type of actuator that can facilitate the rotation of the shaft 16 may be implemented.

Figure 2:
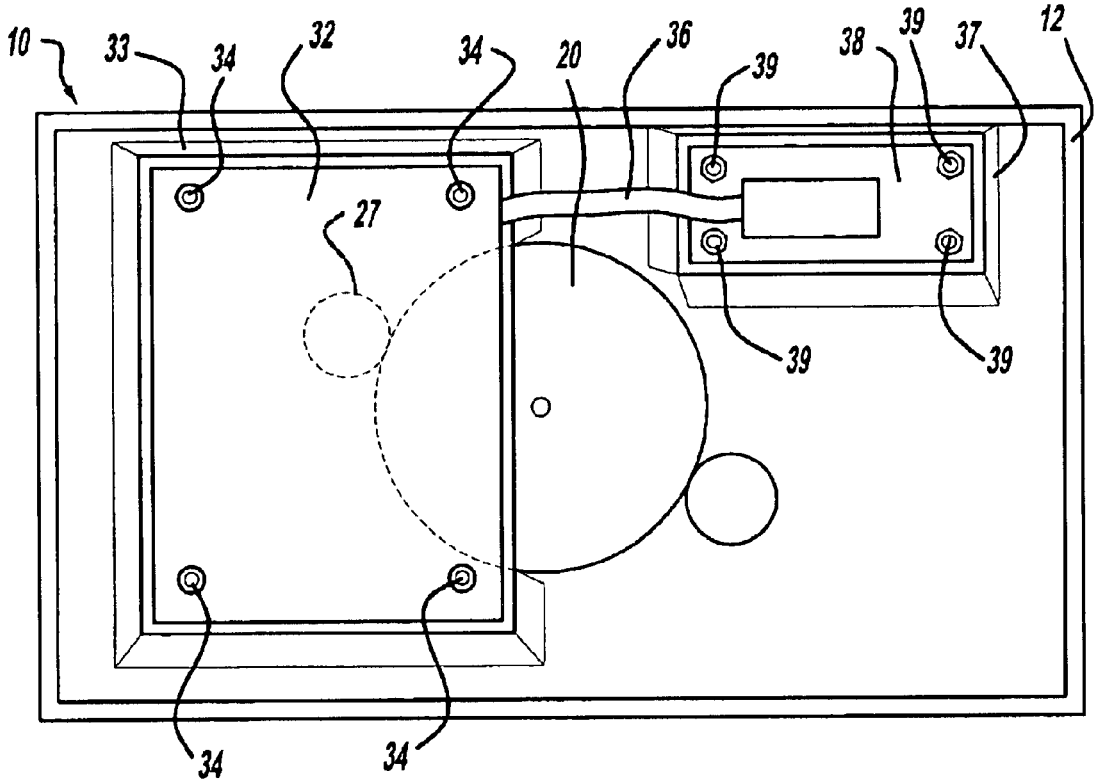
FIG. 2 is a cross-sectional side plan view taken about section line X—X of FIG. 1, however, this particular view also depicts a pre-molded casting that serves as one method of alignment during assembly of the electronic throttle control system.

FIG. 2 is a cross-sectional side plan view taken about section line X—X of FIG. 1, however, this particular view also depicts a pre-molded casting that serves as one method of alignment during assembly of the electronic throttle control system. As shown the electronic throttle control system 10 has a casting or housing 12 which houses all of the individual components of the system. The printed circuit board 32 and the electrical connector 38 are each independently mountable to the casting 12. This is accomplished through the use of a flexible interconnect which connects the printed circuit board 32 and the electrical connector 38. The flexible interconnect allows signals to be communicated between the electrical connector 38 and the sensor assembly 27 and is capable of bending or flexing to accommodate for a range of varying spatial distribution between the printed circuit board 32 and the electrical connector 38. One of the main advantages of this feature is that during assembly it is important to maintain proper air gap between the rotor and the stator so that the sensor will function properly. The flexible interconnect 36 allows the printed circuit board 32, which is fastened to the stator (not shown), to be independently and perfectly aligned with the rotor and the valve shaft, while still allowing for the electrical connector 38 to be independently aligned and connected to the casting. Not only does this feature provide an advantage during assembly of the electronic throttle control system 10 it also compensates for thermal expansion among the various components of the system 10. For example, thermal expansion can occur unevenly among each of the components of the system 10. It is possible for thermal expansion to occur in the printed circuit board region 32 before it occurs at the electrical connector 38. While actual movement caused by thermal expansion is relatively small, it can cause misalignment or changes in the air gap space between the stator and rotor thus affecting the performance of the sensor assembly 27.

As mentioned above, FIG. 2 illustrates one particular method of aligning the electrical connector 38 and the printed circuit board 32. The casting 12 of this particular embodiment has pre-molded alignment depressions. The printed circuit board 32 and sensor assembly 27 can be aligned by placing the printed circuit board 32 within a board depression 33. Once the printed circuit board 32 is aligned it can be fastened to the housing 12 with fasteners 34. The electrical connector 38 can then be aligned by placing the electrical connector 38 within a connector depression 37. Once the electrical connector 38 is aligned it can then be fastened to the housing 12 with fasteners 39.

Figure 3:
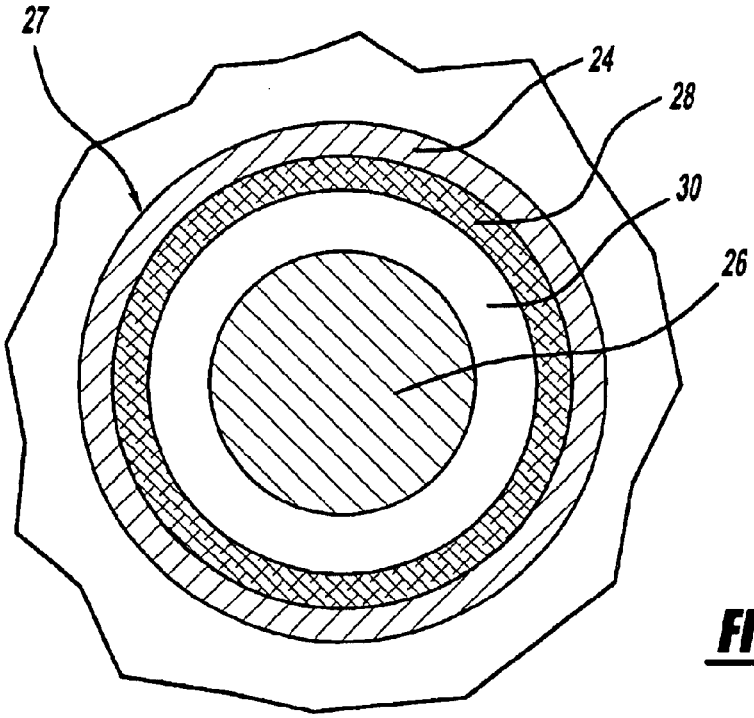
FIG. 3 is a cross-sectional plan view of the sensor assembly taken about section line 3—3 on FIG. 1.

FIG. 3 is a cross-sectional plan view of the sensor assembly 27 taken about section line 3—3 on FIG. 1. The sensor assembly 27 consists of a sensor rotor 24, a sensor stator 26, a magnet layer 28 and an air gap 30. As shown the sensor stator 26 is disposed inside of a nested region of the sensor rotor 24. Disposed on the surface of the sensor rotor 24 is a magnet layer 28. The sensor rotor 24 and sensor stator 26 are positioned so they are not touching and there will be an air gap 30 between the surface of the sensor stator 26 and the magnet 28 layer on the surface of the sensor rotor 24. A sensor assembly of this type is generally referred to as a non-contact sensor, such as a Hall Effect sensor. Examples of prior art Hall Effect sensors are known in the art and can be found with reference to U.S. Pat. No. 5,528,139 to Oudet et al., U.S. Pat. No. 5,532,585 to Oudet et al., and U.S. Pat. No. 5,789,917 to Oudet et al., the entire specifications of which are incorporated herein by reference. However, it is possible for the sensor assembly to incorporate other non-contact or contact sensors that require precise alignment of the sensor assembly.

Figure 4:
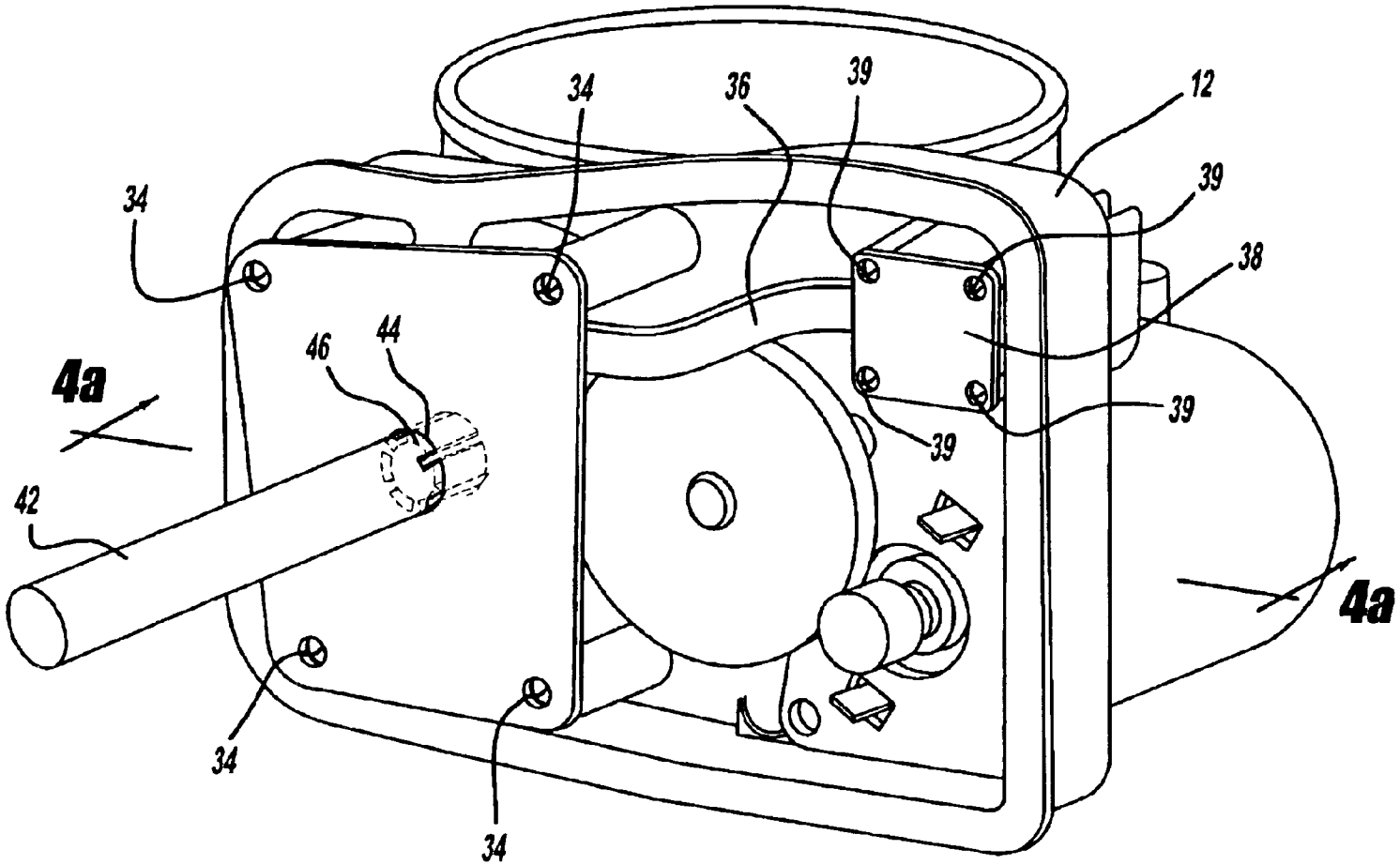
FIG. 4 depicts a perspective view of the throttle control system taken about section line X—X in FIG. 1, wherein this particular view depicts the use of an alignment tool that is used to align the sensor assembly during assembly of the throttle control system.

FIG. 4 depicts a perspective view of the throttle control system taken about section line X—X in FIG. 1, wherein this particular view depicts the use of an alignment tool 42 that is used to align the sensor assembly 27 during assembly of the throttle control system 10. As can be seen, the printed circuit board 32 has a number of slots 44 on its surface which defined the perimeter of the sensor stator 26. The slots 44 allow the insertion of an alignment tool 42 which is used to engage the printed circuit board 32 and the sensor stator 26 so that the printed circuit board 32 and the sensor stator 26 can be properly aligned in relation to the sensor rotor (not shown) during assembly.

After the sensor stator is properly aligned the printed circuit board 32 can be fastened to the casting 12 with fasteners 34. Once the printed circuit board 32 is secure the alignment tool 42 can be disengaged since the sensor stator 26 is not in proper alignment. After securing the printed circuit board 32 and the sensor assembly (not shown) the electrical connector 38 can be aligned and fastened 39 to the casting 12. The flexible interconnect 36 allows electrical connector 38 and the printed circuit board 32 to be assembled independent of each other so that the sensor stator 26 does not become misaligned during completion of assembly.

The alignment tool 42 in this embodiment has six fingers 46 that align with the slots 44. The fingers 46 on the alignment tool 42 are flexible and are capable of bending to grasp onto the sensor stator 26. Once the printed circuit board 32 is fastened to the casting 12, the alignment tool 42 can be easily removed by simply pulling the alignment tool 42 away from the printed circuit board 32.

Figure 4A:
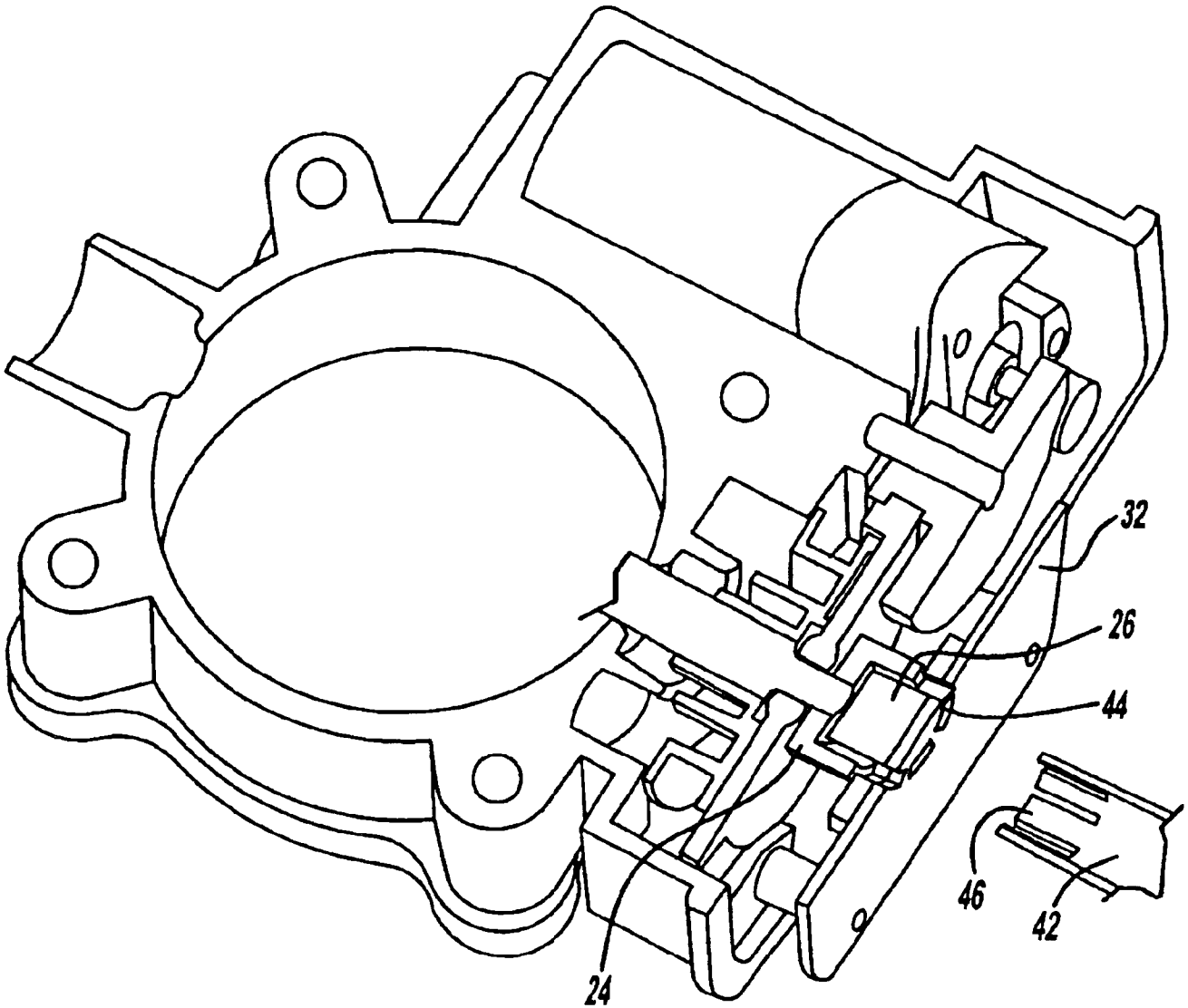
FIG. 4*a* is a cross-sectional view taken about section line 4*a*–4*a* of FIG. 5.
Figure 5:
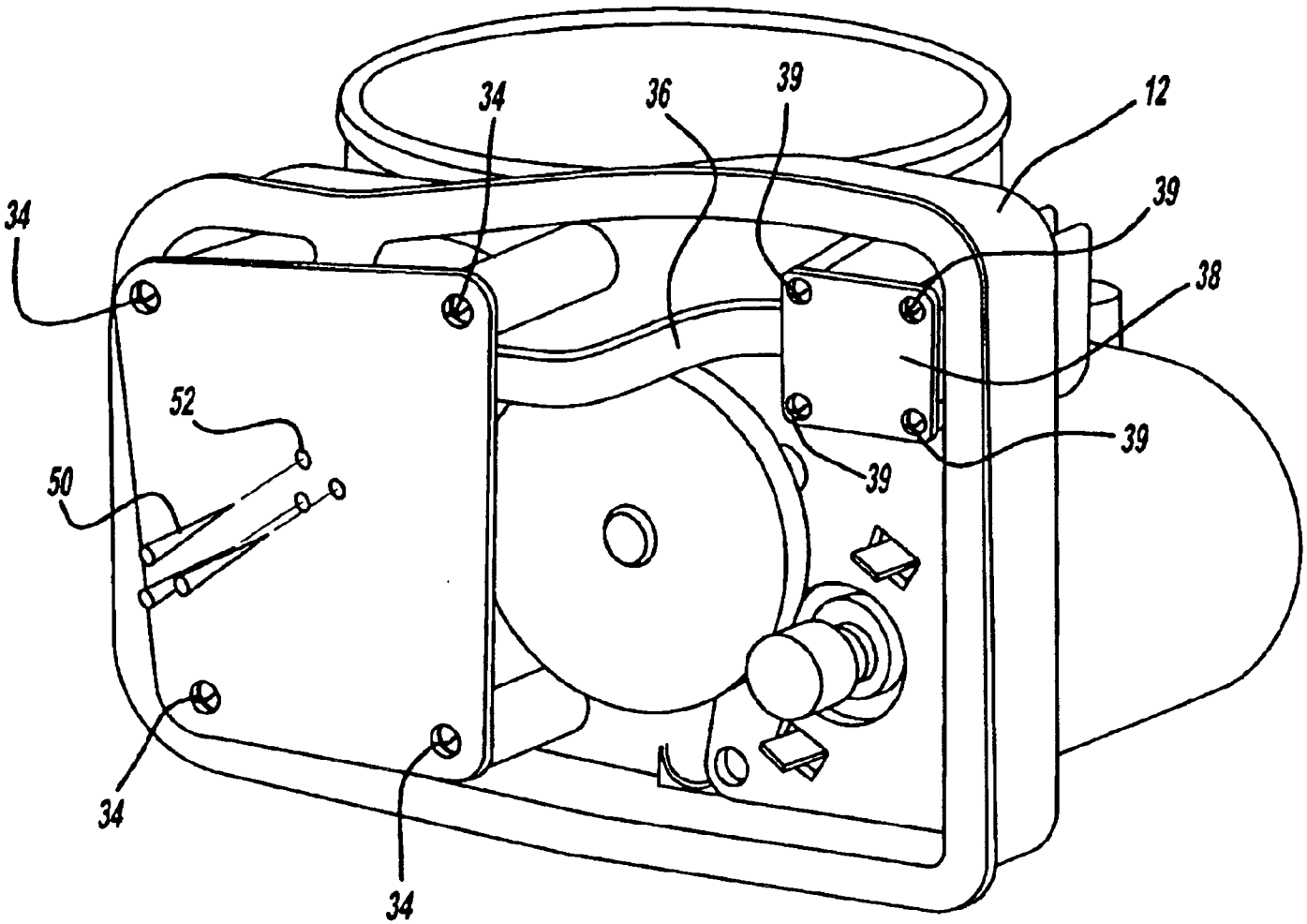
FIG. 5 depicts a perspective view taken about section line X—X of FIG. 1, however, this particular embodiment incorporates the use of alignment holes that are used as an alternate to the alignment slots.

FIG. 4*a* is a cross-sectional view taken about section line 4*a*—4*a* of FIG. 5. The sensor stator 26 is connected to the printed circuit board 32 and the alignment tool 42 is used to position the sensor stator 26 in the nested region of the rotor 24. Once the printed circuit board 32 is fastened to the casting 12, alignment of the sensor stator 26 and the sensor rotor 24 will be maintained and the alignment tool 42 may be removed.

Figure 4B:
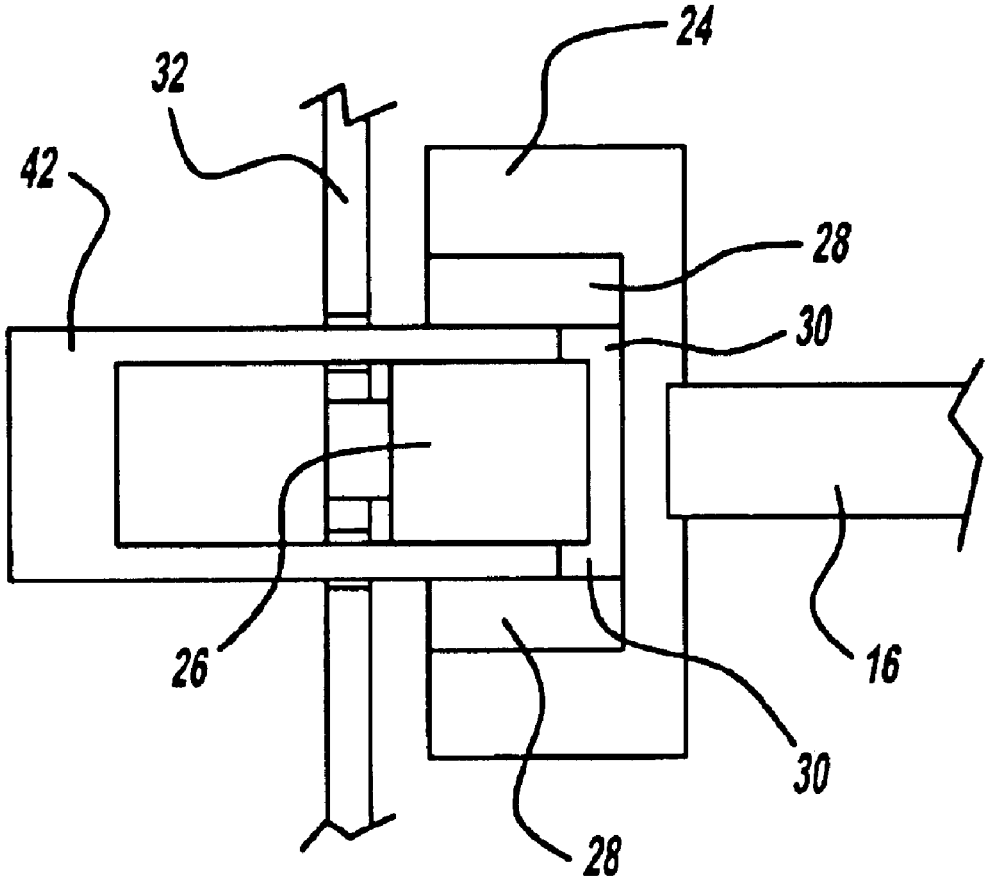
FIG. 4*b* is a cross-sectional view of the sensor assembly being aligned using the alignment tool.

FIG. 4*b* is a cross-sectional view of the sensor assembly being aligned using the alignment tool. The rotor alignment tool 42 can have various configurations. The stator 26 can be positioned at the tip of the rotor alignment tool 42 and can be temporarily engaged to the tip of the rotor alignment tool 42 by pressing the stator 26 onto the tool. The tool 42 can then be used to align the stator 26 and the rotor 24 so that a proper air gap 30 is achieved. The tips of the tool 42 help aid in forming the proper air gap by holding the stator in place during fastening.

FIG. 5 depicts a perspective view taken about section line X—X of FIG. 1, however, this particular embodiment incorporates the use of alignment holes 52 that are used as an alternate to the alignment slots. During assembly and alignment of the printed circuit board 32 and stator 26 with respect to the magnet 28 and rotor 24, individual tapered pins 50 are inserted through the alignment holes 52 in a manner similar to the alignment tool 42 depicted in FIG. 5. The tapered pins 50 are used to align the sensor stator 26 with respect to the magnets 28 of the rotor 24 so that a properly spaced air gap 30 is created during assembly. Once the printed circuit board 32 is fastened to the casting 12 the tapered pins 50 are then removed. In this particular embodiment of the invention the pins 50 are tapered to prevent over-insertion and ease the insertion and retraction of the pins 50, however, it is possible to use pins 50 of virtually any type of configuration.

Once the printed circuit board 32 is fastened to the casting the electrical connector 38 can also independently be aligned and fastened to the casting 12. Once again the flexible interconnect 36 plays an important role by allowing the electrical connector 38 and the printed circuit board 32 to each be aligned and fastened to the casting 12 independently of each other. This eliminates the possibility of misalignments of the sensor assembly 27 when the electrical connector 38 is connected to the casting. Additionally, as stated earlier the use of the flexible interconnect 36 also prevents misalignment of the sensor assembly 27 during thermal expansion which may occur during normal operation of the throttle control system 10.

In operation, the present invention functions by employing feedback between the various sensor systems (e.g., sensor rotor/sensor stator) and the various control assemblies (e.g., the motor) in order to properly position the throttle plate so as to achieve optimal performance of the electronic throttle control system. The present invention can be employed in any type of rotary actuator employing a position sensor.

Figure 6:
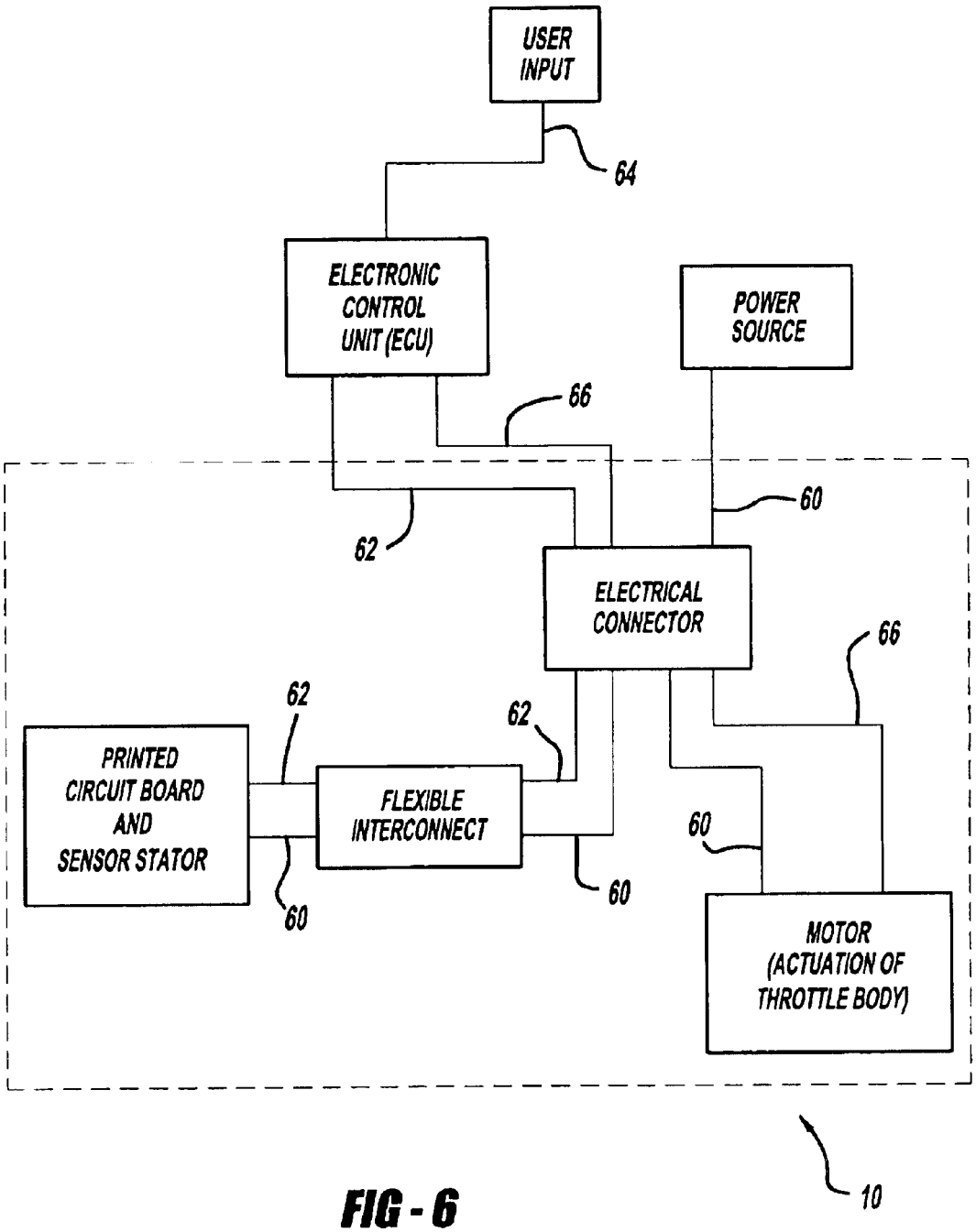
FIG. 6 depicts a schematic view of the operation of the throttle control system.

FIG. 6 depicts a schematic view of the operation of the throttle control system. The throttle control system 10 operates using an external electrical control unit (ECU). The ECU is a logic circuit that receives a user input signal 64 and a throttle position signal 62 and generates a control signal 66 to the motor via the electrical connector.

The electrical connector of the throttle control system 10 also receives power 60 from a power source. The power is distributed through the electrical connector to the motor and the sensor stator via the flexible interconnect and sensor stator.

The user input signal 64 is a value that indicates the user's desired throttle position. The user input signal 64 can be generated from a user input such as, an accelerator pedal (not shown).

The throttle position signal 62 is generated by the sensor stator via the printed circuit board, the flexible interconnect and the electrical connector. The throttle position signal 62 is a value that indicates the present angular position of the throttle plate (not shown). In a preferred embodiment of the invention the throttle position signal is an analog position signal. However, it is in the scope of this invention to have a throttle position signal that is digital.

The ECU analyzes the values of the user input signal 64 and the throttle position signal 62 to determine if the throttle position signal 62 matches the user input signal 64. If the two signal values do not match then the ECU will generate a control signal 66 to the motor which is inputed to the throttle control system 10 via the electrical connector. The motor receives the control signal 66 and actuates the throttle body so that actual angular position of the throttle valve matches the desired angular position of the user which will be confirmed by the ECU when the throttle position signal 62 and the user input signal 64 both match.

The printed circuit board serves as a housing for the sensor stator 26. In a preferred embodiment of the invention, the sensor stator generates an analog to position signal that travels through wiring (not shown) on the printed circuit board. The position signal then exits the printed circuit board through the flexible interconnect and travels to the ECU via the electrical connector. The printed circuit board preferably has no logic, however, it may contain resistors, capacitors, and amplifiers necessary for the position signal. However, it should be understood that it is within the scope of this invention to incorporate a printed circuit board that has logic functions.

In addition to carrying the position signal, the flexible interconnect also supplies power from the electrical connecter to the sensor stator via the printed circuit board. In an embodiment where the printed circuit board has Logic functions it should also be understood that the flexible interconnect would also be capable of carrying a user input signal to the motor. The flexible interconnect can have many physical forms. For example, in the present embodiment the flexible interconnect may be bare metal wires, however, it is possible to use a ribbon wire or plastic coated wires in embodiments where the flexible interconnect will need to insulated.

The preferred embodiment of the invention has an external ECU. The ECU receives a position signal from the sensor stator. This signal indicates the angular position of the throttle plate. The ECU also receives a user input signal that indicates the user's desired angle of the throttle plate. The ECU takes the values of the user input signal and the position signal and generates a control signal based on the values. The control signal is sent to the motor and causes the motor to rotate the gear train, the throttle shaft and throttle plate (see FIGS. 1–2) so the throttle plate reaches the angle desired by the user.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electronic throttle control system comprising:

a housing;

a throttle bore formed within said housing;

a throttle plate disposed within said throttle bore;

a throttle shaft operably connected to said throttle plate;

a sensor assembly operably aligned with said throttle shaft;

an electrical connector for distributing connections between said sensor assembly and said motor;

a motor is operably associated with the throttle shaft for effecting the movement of said throttle shaft in response to a control signal that is inputted from said electrical connector; and a flexible interconnect connected between said sensor assembly and said electrical connector, wherein said flexible interconnect functions as a medium to transmit control signals between said sensor stator and said motor.

2. The electronic throttle control system of claim 1 wherein said sensor assembly further comprises:

a sensor rotor connected to the said first end of said throttle shaft, wherein said sensor rotor includes a nested area;

a sensor stator positioned inside of said nested area in close proximity to said sensor rotor so that said sensor rotor can rotate freely about said sensor stator, said sensor stator and said sensor rotor being separated by an air gap; and a magnet assembly disposed inside of said nested area formed by said sensor rotor and said sensor stator.

3. The electronic throttle control system of claim 2 further comprising a printed circuit board electronically connected to said sensor stator and said flexible interconnect, wherein said printed circuit board is connectable to said housing and forms a mounting surface for said stator.

4. The electronic throttle control system of claim 3 wherein said printed circuit board is a Logic chip capable of functioning as an electronic control unit for receiving a user input signal, and throttle position signal and transmitting a control signal to said motor.

5. The electronic throttle control system of claim 3 further comprising at least one aperture through said printed circuit board adjacent the edge of said stator, wherein said aperture may be used for the insertion of an alignment tool.

6. The electronic throttle control system of claim 5 further comprising an alignment tool inserted inside of said aperture.

7. The electronic throttle control system of claim 6 wherein said alignment tool has a tip with one or more flexible fingers configured to slide into said aperture so that said fingers are positioned between said rotor and said stator during alignment, wherein said flexible fingers are configured to bend, engage and hold said stator during alignment.

8. The electronic throttle control system of claim 7 wherein said aperture is two or more holes spaced about the edge of said stator and said alignment tool is two or more tapered pins that are inserted between said stator and said rotor.

9. The electronic throttle control system of claim 8 further comprising a gear train connected between said motor and said throttle shaft, wherein said gear train rotates said throttle shaft in response to actuation of said motor.

10. The electronic control system of claim 9 wherein said gear train has a spring system interconnected to said gear train that is part of an emergency fail-safe system.

11. The electronic throttle control system of claim 9 wherein the rotation of said throttle shaft is accomplished with one or more belts connected between said motor and said throttle shaft, wherein said one or more belts rotate said throttle shaft in response to said actuation of said motor.

12. The electronic throttle control system of claim 11 wherein said one or more belts is one or more chains.

13. The electronic throttle control system of claim 1 wherein said sensor assembly is a non-contact sensor.

14. An electronic throttle control system comprising:

a casting;

a throttle bore formed within said casting;

a throttle plate disposed within said throttle bore;

a throttle shaft extending across said throttle bore, wherein said throttle shaft has a first end and a second end;

a gear train that operably connects to said throttle shaft and effectively rotates said throttle shaft, wherein said gear train has a spring system interconnected to said gear train that is part of an emergency fail-safe system;

a sensor rotor connected to the said first end of said throttle shaft, wherein said sensor rotor is configured to have a nested area;

a sensor stator positioned inside of said nested area in close proximity to said sensor rotor so that said sensor rotor can rotate freely about said sensor stator;

a magnet assembly disposed inside of said nested area formed by said sensor rotor and said sensor stator, wherein said nested area has an air gap between said stator and said magnetic assembly, wherein said magnetic assembly is a non-contact sensor;

a printed circuit board fastened to said casting, said printed circuit board being electrically connected to and forming a mounting surface for said sensor stator, wherein said printed circuit board, said sensor stator and said casting are all fastened together using one or more fasteners;

an electrical connector fastened to said casting;

a motor connected to said electrical connector, wherein said motor controls the position of said throttle plate by rotating said gear train in response to a control signal that is inputted from said electrical connector; and a flexible interconnect connected between said electrical connector and said printed circuit board for insulating the sensor from misalignment due to thermal expansson.

15. An electronic throttle control system comprising:

a housing;

a throttle bore formed within said housing;

a throttle plate disposed within said throttle bore a throttle shaft connected to said throttle plate and extending across the throttle bore, said throttle shaft have a first end and a second end;

a sensor rotor connected to said first end of said throttle shaft, wherein said sensor rotor includes a nested area;

a sensor stator positioned inside of said nested area in close proximity to said sensor rotor so that said sensor rotor can rotate freely about said sensor stator, said sensor stator and sensor rotor being separated by an air gap;

a magnet assembly disposed inside of said nested area formed by said sensor rotor and said sensor stator;

a printed circuit board connected to and forming a mounted surface for said sensor stator;

an electrical connector connected to said printed circuit board; and a motor connected to said electrical connector, wherein said motor controls the position of the throttle plate by rotating said throttle shaft in response to a control signal that is inputted from said electrical connector, wherein the rotation of said throttle shaft is accomplished with one or more belts connected between said motor and said throttle shaft, wherein said one or more belts rotate said throttle shaft in response to said actuation of said motor.

16. The electronic throttle control system of claim 15 wherein said one or more belts is one or more chains.

17. A method of electronically controlling a throttle comprising the steps of:

providing a throttle body including a throttle bore, and a throttle plate connected to an actuation shaft;

providing a motor operatively connected to said throttle plate for controlling the throttle based on a user input;

providing a non-contact sensor assembly which requires precise permanent alignment with said shaft; and providing a flexible connector for connecting said motor to said sensor.

18. The method of claim 17 wherein the precise alignment of said non-contact sensor assembly is accomplished using an alignment tool configured to removably grasp and hold said sensor assembly relative to said rotor.

19. A method of electronically controlling a throttle comprising the steps of:

aligning an electrical connector on a housing;

fastening said electrical connector to said housing;

engaging an alignment means to a stator;

aligning said stator to a precise alignment relative to a throttle shaft, wherein said stator and said throttle shaft form a non-contact sensing element;

fastening said stator so said housing; and disengaging and removing said alignment means from said stator.

20. The method of claim 19 further comprising the step of:

providing a flexible interconnect for connecting said stator and said electrical connector wherein said flexible interconnect permits the independent aligning and fastening of said electrical connector and said stator.

* * * * *